US006021543A

United States Patent [19]

Allen

[11] Patent Number: 6,021,543

[45] Date of Patent: Feb. 8, 2000

[54] SINGLE TANK RETRIEVAL SYSTEM

[76] Inventor: Henry W. Allen, 4134 Lake Limestone Ct., Baton Rouge, La. 70816

[21] Appl. No.: 09/013,461

[22] Filed: Jan. 26, 1998

Related U.S. Application Data

[60] Provisional application No. 60/036,473, Jan. 27, 1997.

[51] Int. Cl.[7] ..... B08B 9/093

[52] U.S. Cl. ..... 15/304; 15/246.5; 15/315; 134/167 R

[58] Field of Search ..... 15/1.7, 246.5, 15/304, 315, 340.1; 134/167 R, 168 R

[56] References Cited

U.S. PATENT DOCUMENTS

| | | | |
|---|---|---|---|
| 4,805,650 | 2/1989 | Yasui et al. | 134/167 R |
| 5,037,486 | 8/1991 | Sloan | 134/168 R |
| 5,138,741 | 8/1992 | Allen . | |
| 5,269,041 | 12/1993 | Allen . | |
| 5,335,395 | 8/1994 | Allen . | |
| 5,561,883 | 10/1996 | Landry et al. | 15/304 |
| 5,594,973 | 1/1997 | Brusseleers et al. | 15/304 |
| 5,640,982 | 6/1997 | Landry et al. | 134/167 R |
| 5,713,101 | 2/1998 | Jackson | 134/167 R |
| 5,749,384 | 5/1998 | Hayashi et al. | 134/167 R |

*Primary Examiner*—Terrence R. Till
*Attorney, Agent, or Firm*—David L. Ray

[57] ABSTRACT

A retrieval system including a single tank for placement in communication with an underground storage tank in which waste or sludge is stored, the tank having equipment for lowering a remote controlled sludge removal apparatus into the underground storage tank to dislodge and remove sludge or waste from the underground storage tank and convey the sludge or waste to a storage area remote from the underground storage tank. The system can also be utilized to lower other tools into an underground storage tank.

4 Claims, 7 Drawing Sheets

SINGLE TANK RETRIEVAL SYSTEM

CROSS-REFERENCE TO RELATED APPLICATIONS

This application claims the benefit of the filing date and priority of co-pending provisional application Ser. No. 60/036,473 filed Jan. 27, 1997.

BACKGROUND OF THE INVENTION

1. Field of the Invention

The invention relates to remote controlled sludge removal apparatus and systems. More particularly, the present invention relates to apparatus and systems for accessing storage tanks, dislodging waste, including nuclear waste, from storage areas, and conveyance of the waste to a storage area.

2. Description of the Related Art

My U.S. Pat. Nos. 5,335,395; 5,269,041; and 5,138,741 disclose sludge removal apparatus having tracks thereon for propelling the sludge removal apparatus over the area being cleaned by the apparatus, the sludge removal apparatus having sludge dislodging apparatus thereon, the tracks being foldable to enable the waste removal apparatus to be inserted through a pipe, manway or riser having an inside diameter of 24 inches. The sludge removal apparatus includes a pump for pumping waste from the sludge removal apparatus is traversing.

It is the object of the present invention to provide a system and apparatus for introducing a sludge removal apparatus such is that disclosed in U.S. Pat. Nos. 5,335,395; 5,269,041 and 5,138,741 into a tank or area containing waste and sludge and remove and transport the waste to a storage area.

SUMMARY OF THE INVENTION

In accordance with the present invention there is provided a waste retrieval system including a single tank for placement above and in communication with an underground storage tank in which waste and sludge is stored, the single tank having equipment for lowering a remote controlled sludge removal apparatus into the underground storage tank to dislodge and remove waste from the underground storage tank and convey said waste to a storage area remote from the underground storage tank.

DESCRIPTION OF THE PREFERRED EMBODIMENTS

Figure 1:
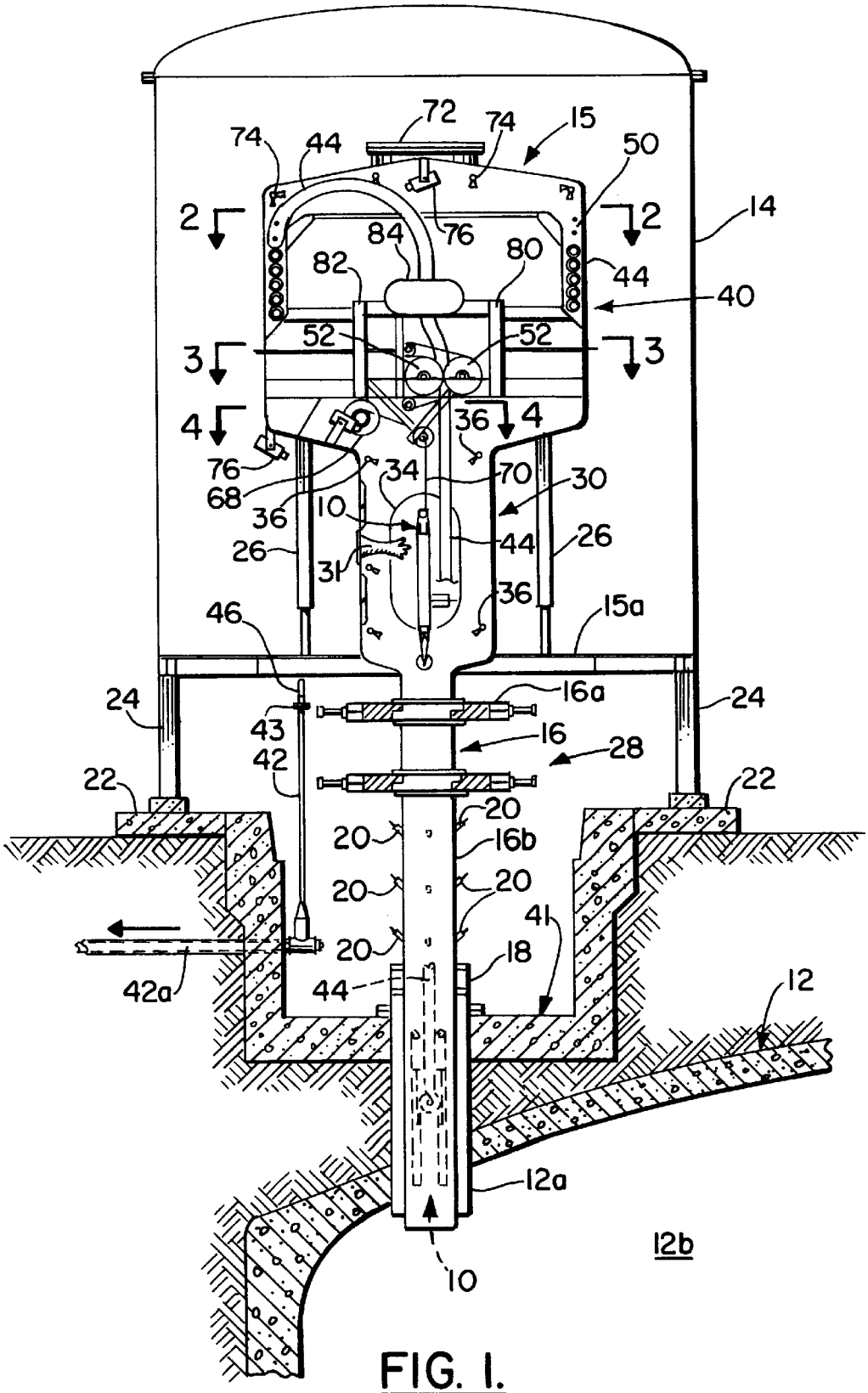
FIG. 1 is a schematic side elevational view, partly cut-away, of the single tank retrieval system of the invention.

Referring now to the drawings, a remote controlled sludge removal apparatus generally indicated by the numeral 10 in FIG. 1 can be introduced into an underground storage tank generally indicated by the numeral 12 in accordance with the present invention. The remote controlled sludge removal apparatus 10 is disclosed in my U.S. Pat. Nos. 5,35,395; 5,269,041; and 5,138,741 which are hereby incorporated by reference. If desired, the sludge removal apparatus 10 could be fitted with tool systems or robotic arms for retrieving foreign objects from underground storage tank 12.

The single tank retrieval system of the invention is housed in a generally cylindrical tank generally indicated by the numeral 15. Tank 15 consists of decontamination capsule 30 and umbilical storage tank 40. Tank 15 has an access pipe connected thereto generally indicated by the numeral 16 extending downwardly therefrom which enables communication between the interior of tank 15 and the interior 12*b* of underground storage tank 12. Tank 15 is sealed to prevent any radioactive waste or other dangerous substances from sludge or waste in underground storage tank 12 from contaminating the environment.

Access pipe 16 extends downwardly from tank 15 through slide valve 16*a* and is connected to slide valve 28. Access pipe 16*b* extends downwardly from slide valve 28 through underground storage tank 12 and inlet pipe 12*a* into the interior 12*b* of underground storage tank 12. A seal 18, which is preferably a hydraulic seal, seals pipe 16*b* to inlet pipe 12*a*.

A plurality of nozzles 20 are connected to access pipe 16*b* as shown in FIG. 1. Nozzles 20 spray liquids inside access pipe 16*b* onto sludge removal apparatus 10, when the sludge removal apparatus 10 is inside pipe 16*b* as shown in phantom lines in FIG. 1, to rinse sludge and waste on sludge removal apparatus 10 downwardly into underground storage tank 12. Sludge removal apparatus shown in phantom lines in pipe 16*b* is shown rotated 90 degrees from the sludge removal apparatus 10 shown in solid lines in solid lines in FIG. 1. Preferably spray nozzles 20 are designed for a maximum pressure of 10,000 PSI (pounds per square inch) and operate at pressures of 50 to 3,000 PSI (pounds per square inch) and 25 to 100 gallons per minute. Conventional flexible hoses (not shown) will connect the spray nozzles 20 to a common piping manifold system.

Tank 15 is rigidly connected to floor 15*a*. Tank 15 can be trucked to an underground storage tank 12 and aligned with inlet pipe 12*a* by a crane or other lifting device. Tank 15 is positioned over inlet pipe 12*a* and supported on preferably four footing foundations 22 and four adjustable legs 24. The four adjustable legs 26 connected to tank 15 and floor 15*a* enable precise positioning and alignment of tank 15 and access pipe 16 with slide valve 28 connected to pipe 16*b*. Preferably slide valve 28 and pipe 16*b* is connected to inlet pipe 12*a* prior to aligning tank 15 and access pipe 16 with slide valve 28.

Tank 15 includes a de-contamination capsule generally indicated by the numeral 30. Preferably de-contamination capsule 30 has ½ inch thick stainless steel walls with a mirror finish inside. Preferably the inside diameter of the de-contamination capsule 30 is 3 feet 6 inches and the height is 8 feet 9 ½ inches. De-contamination capsule 30 houses the remote controlled sludge removal apparatus 10 and provides the enclosure that contains contaminants, waste and sludge and returns them to the underground storage tank 12.

Chemically resistant gloves 31 are sealed to the wall of the de-contamination capsule so that personnel can manipulate the remote controlled sludge removal apparatus 10 and other components therein and avoid contamination from the sludge and waste in the underground storage tank 12 and to prevent the environment from being contaminated with waste or sludge from the underground storage tank 12. As many gloves 31 can be provided as needed to attach devices such as sludge removal apparatus 10 which are to be lowered into underground storage tank 12.

The various tools and devices to be lowered into underground storage tank 12 may be stored inside decontamination capsule 30. An entrance hatch or manway 34 preferably has a double door to provide contamination free sealing. Preferably only one door will be open at a time when personnel enter the decontamination capsule 30, thus assuring sludge and waste from the underground storage tank 12 will not escape to the outside environment; a positive pressure on the inside of decontamination capsule 30 will also be maintained.

A plurality of nozzles 36 are provided for spraying water and other liquids inside of decontamination capsule 30 to remove any waste or contaminates from the underground storage tank and to wash the contamination down that might have been introduced into decontamination capsule 30 by retrieving sludge removal apparatus 10 upwardly into decontamination capsule 30 from underground storage tank 12.

Preferably contaminate sensing monitors are installed inside and outside the decontamination capsule 30 to sense the amount of waste such as radio active waste that maybe entering the inside of the decontamination capsule and which may be found outside the decontamination capsule. If contamination reaches dangerous levels, an alarm would be sounded.

Located at the upper end of tank 15 and above decontamination capsule 30 is the umbilical storage tank generally indicated by the numeral 40. Preferably, umbilical storage tank 40 is approximately 12 feet in diameter and provides for deployment and retrieval of the umbilical system for lowering apparatus into underground storage tank 12 and retrieving the apparatus from the underground storage tank 12 upwardly into the decontamination capsule 30.

Figure 3:
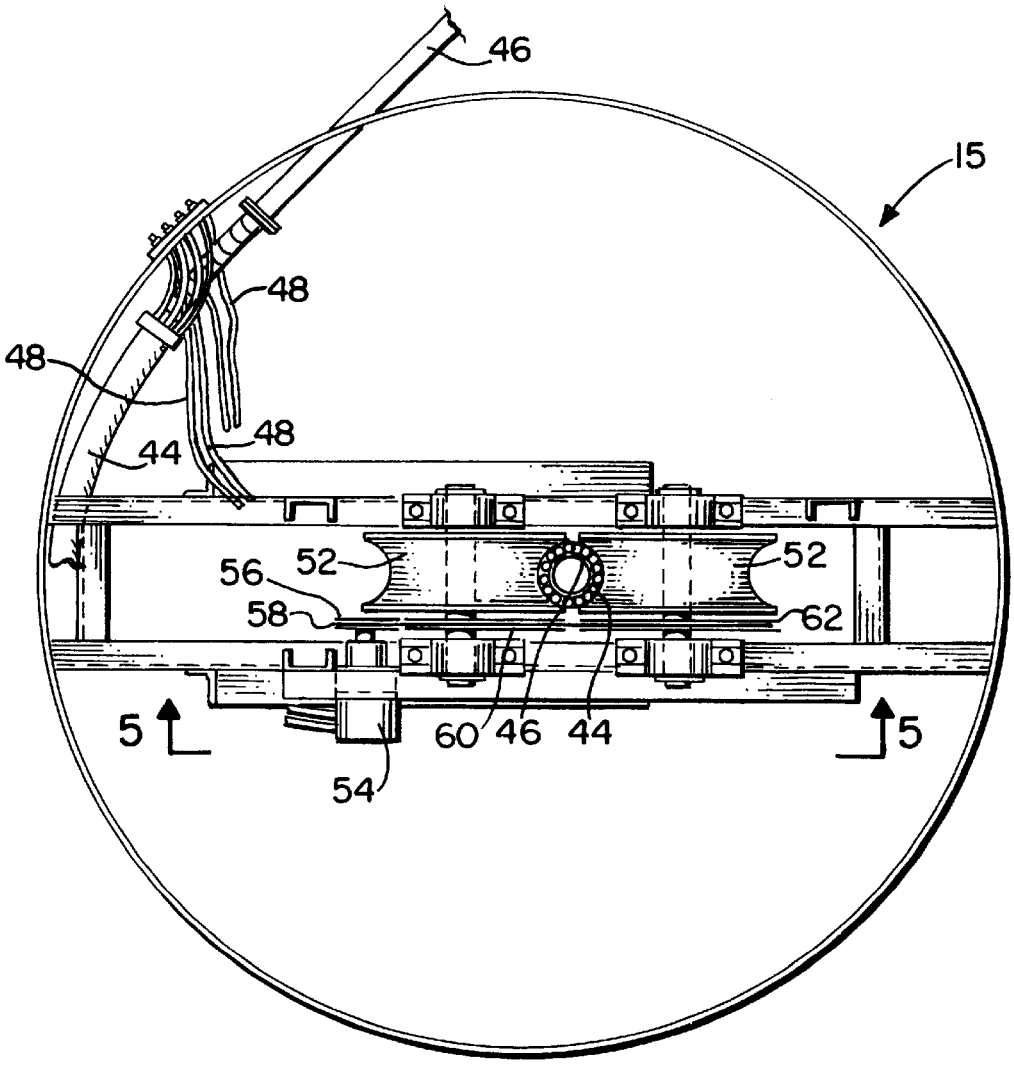
FIG. 3 is a cross sectional view taken along lines 3—3 of FIG. 1.

Waste and sludge discharge lines 42 and 42*a* are shown extending upward from the inside of the concrete pump pit generally indicated by the numeral 41. Discharge line 42 conveys sludge pumped from underground storage tank 12 pumped by sludge removal apparatus 10 through hose 46. The portion of hose 46 extending outward from tank 15 in FIG. 3 is connected to the upper end of discharge line 42 by flange 43 as shown in FIG. 1. Lines 42 and 42*a* convey waste from underground storage tank 12 to a remote storage area in the direction indicated by the arrow above line 42*a* in FIG. 1.

Umbilical hose 44 is constructed preferably of a chemically resistant material which encapsulates the pump discharge hose 46 which discharges into pipe 42. Umbilical hose 44 also contains hoses 48 which water feed hoses and hydraulic hoses for conveying hydraulic fluids pumped to sludge removal apparatus 10. These hoses control the function of sludge removal apparatus 10 in underground storage tank 12. Umbilical hose 44 is connected to sludge removal apparatus 10 as shown in FIG. 1 and is also used to lower and raise sludge removal apparatus 10 from the interior 12*b* of underground storage tank 12.

Figure 2:
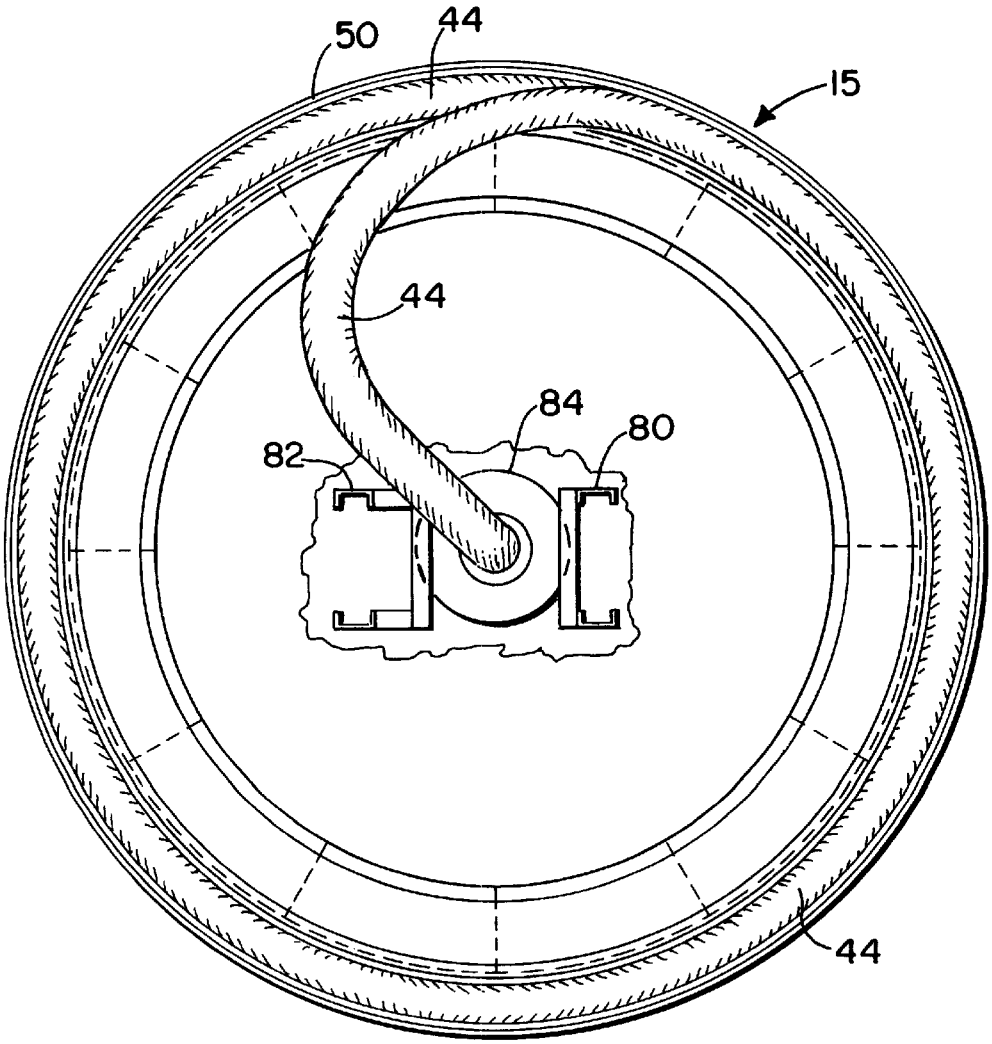
FIG. 2 is cross sectional view taken along lines 2—2 of FIG. 1.

Umbilical hose 44 is stored in the hose containment trough 50. As shown in FIG. 2, umbilical hose 44 extends from trough 50 through guide 84 which is connected to and supported by support members 80 and 82. Umbilical hose 44, and sludge removal apparatus 10 connected thereto, is lowered and raised by pinch rollers generally indicated by numerals 52. As can best be seen in FIGS. 1 and 3, pinch rollers 52 contact umbilical hose 44 on each side thereof which sufficient force to grip and suspend umbilical hose 44 when any apparatus such as remote controlled sludge removal apparatus 10 is connected thereto and is being lowered or retrieved from underground storage tank 12.

Pinch rollers 52 may have a roughened surface or teeth thereon to increase the friction of the surface of the pinch rollers with the outside of hose 44. Pinch rollers 52 are preferably offset from the center of tank 15 to allow horizontal forces to relieve some vertical forces from the surface of pinch rollers 52. Pinch rollers 52 are driven by electric motor 54 shown in FIG. 3 which drives sheave 56 having drive belt 58 thereon. Drive belt 58 in turn drives sheaves 60 and 62 which are connected to the pinch rollers 52 and cause them to turn. Various idler rollers are idler sheaves 64 and 66 maybe provided as desired.

Figure 4:
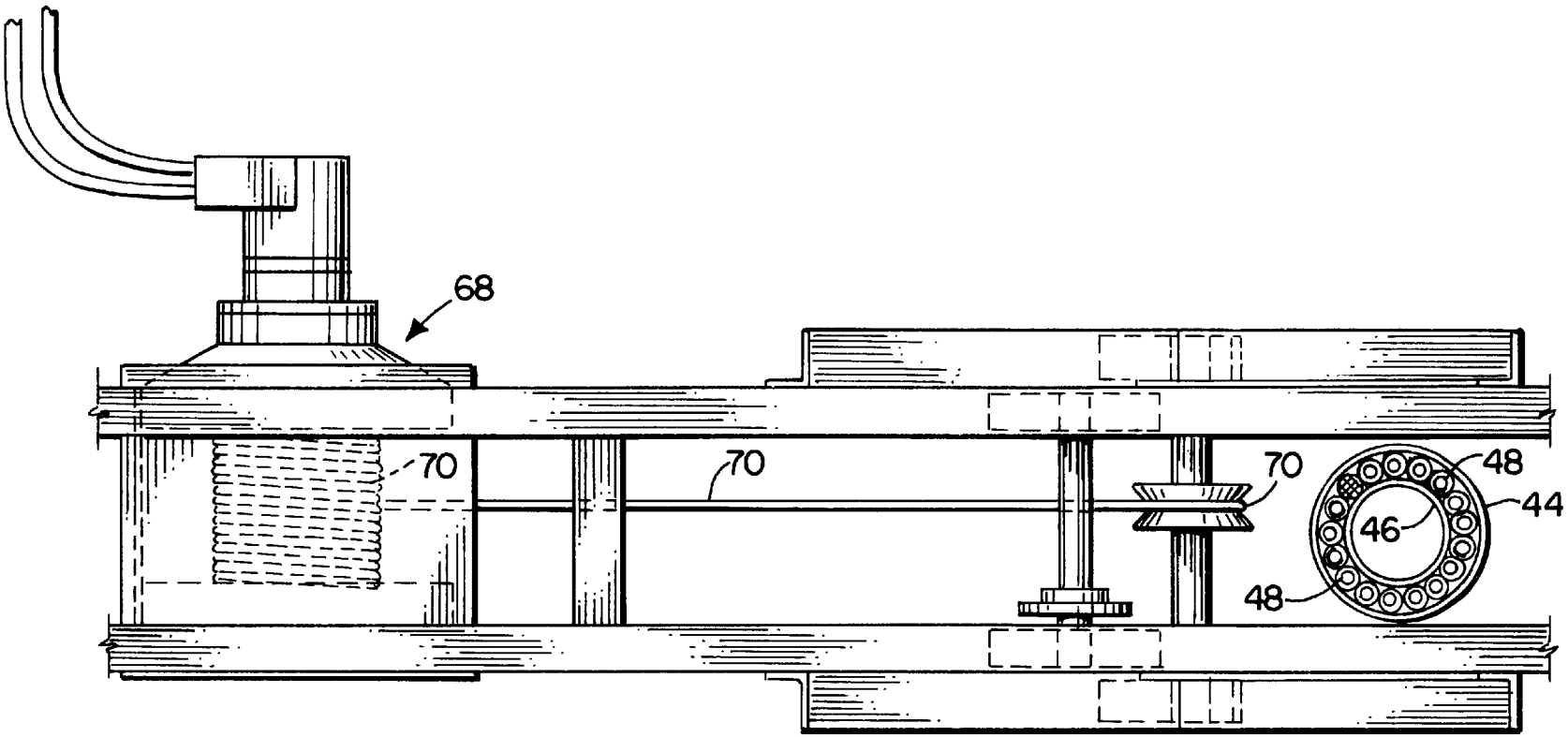
FIG. 4 is cross sectional view taken along lines 4—4 of FIG. 1.
Figure 5:
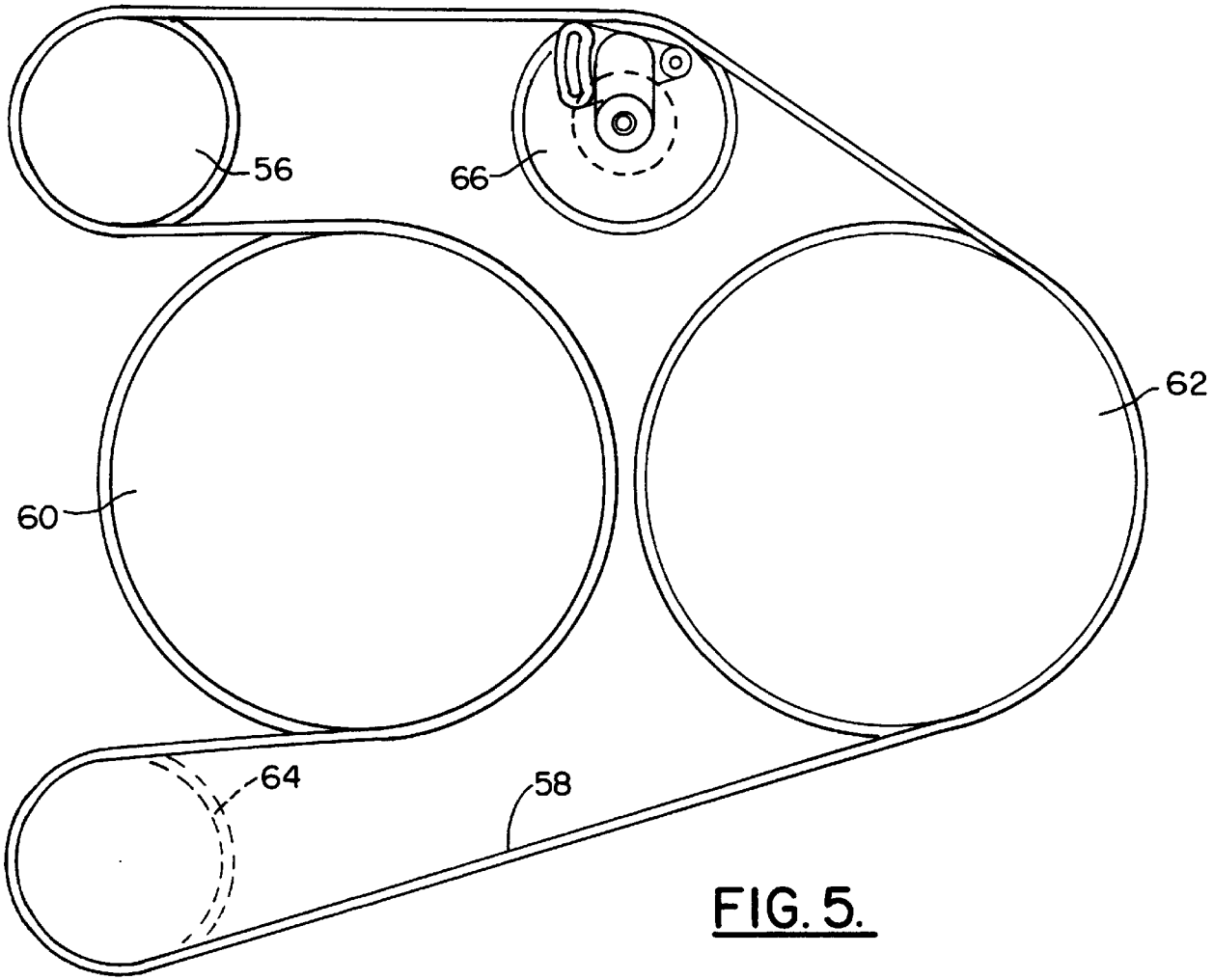
FIG. 5 is an enlarged schematic view of the pulley system of the present invention taken along lines 5—5 of FIG. 3.

A backup hydraulic or electronic winch generally indicated by the numeral 68 shown in FIG. 1 and shown in detail in FIG. 4. Winch 68 lowers and raises cable 70 which is connected to sludge removal apparatus 10 as shown in FIG. 1. Winch 68 is used to provide additional lifting force for lifting sludge removal apparatus 10 upward from the interior of underground storage tank 12 in case of accidental failure of the umbilical hose 44 to lift sludge removal apparatus 10.

During deployment and retrieval operations of sludge removal apparatus 10, air is filtered through the top of the tank 40 down into the underground storage tank 12 and is vented through the underground storage tank's existing vent system (not shown). A manhole 72 is provided in the top of tank 40 for access through the top of the tank. A plurality of spray nozzles 74 may be located around the top of the tank 40 for washing waste and sludge from hose 44. Cameras 76 are preferably located in tank 15 in order the view the interior of the tank in the event of a system failure.

Slide valve 16*a* is connected to pipe 16 for positive shut off of the tank 15 pipe 16 are removed from slide valve 28 and moved to another site. The purpose of valve 16*a* is to prevent contamination that might be found inside of tank 15 from reaching the environment during transport of tank 15 from one site to another.

If desired, tank 15 can be covered by cylindrical cover 14 to prevent damage to tank 15 and personnel by wind blown objects.

Figure 6:
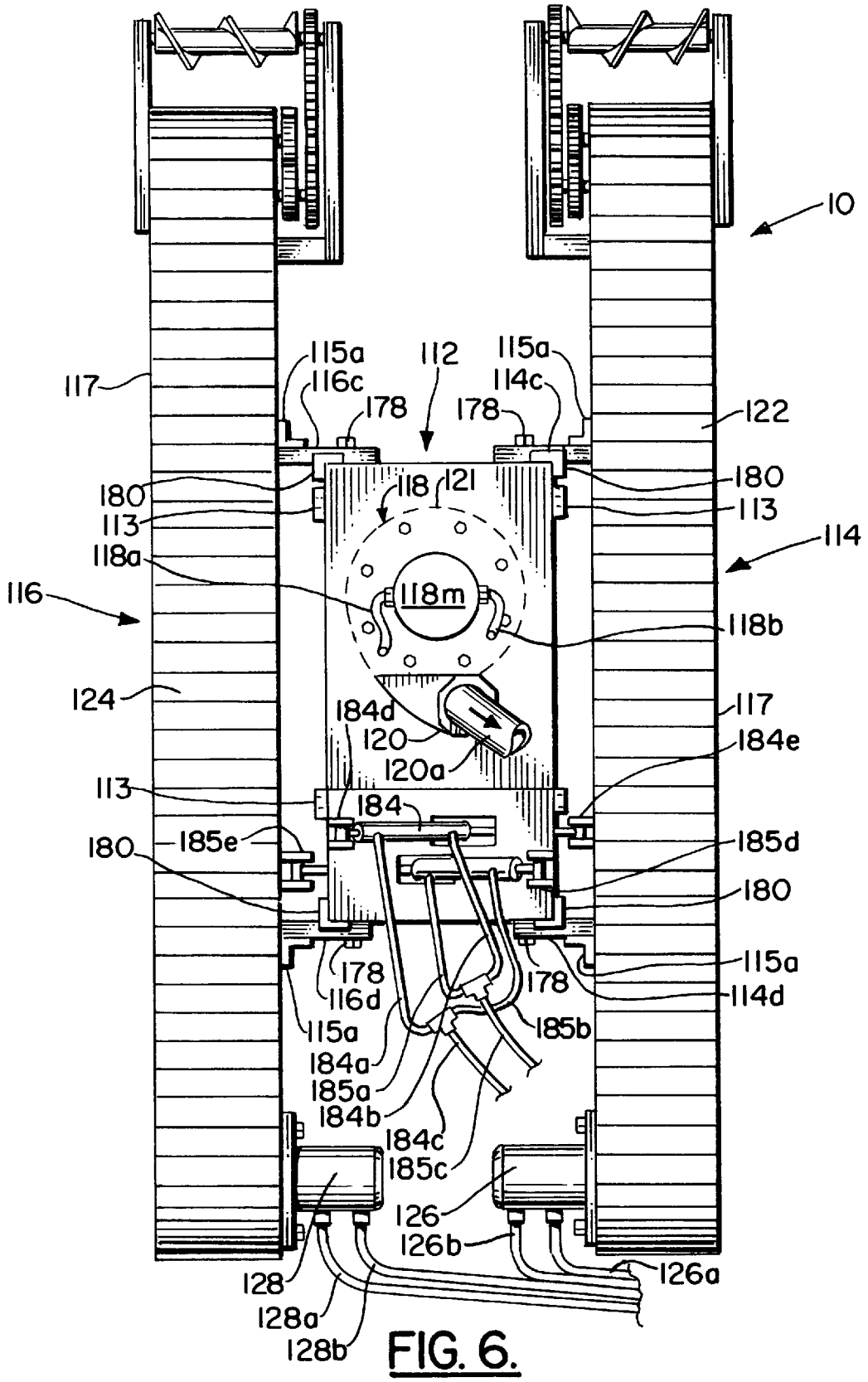
FIG. 6 is a schematic, partly cut-away, top view of the sludge removal apparatus of U.S. Pat. No. 5,269,041.
Figure 7:
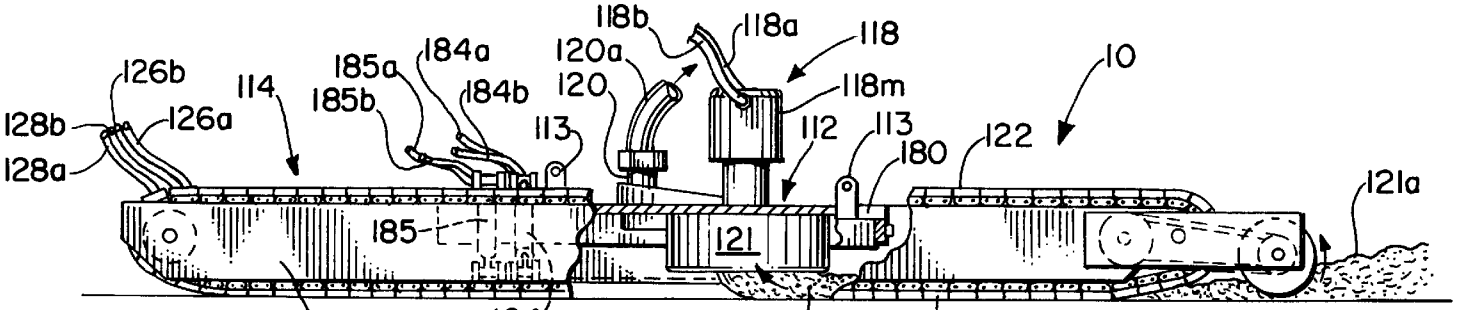
FIG. 7 is a partly cut-away side elevational view of the apparatus of U.S. Pat. No. 5,269,041 cleaning the bottom of a storage tank.
Figure 8:
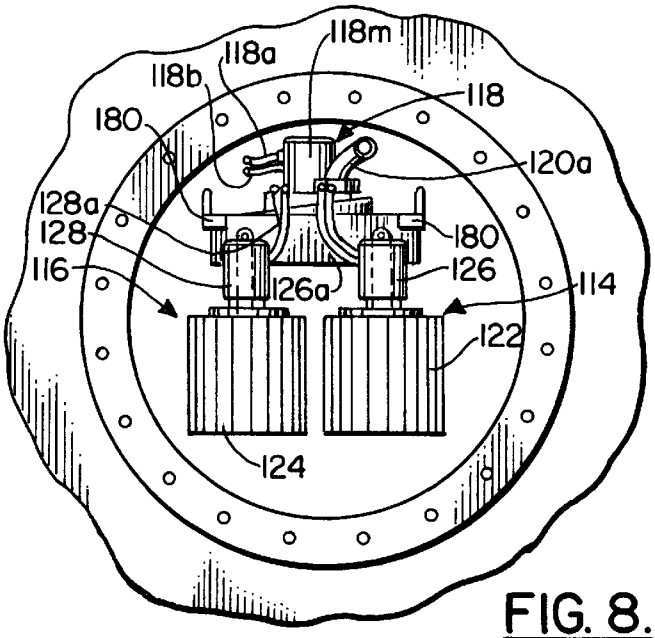
FIG. 8 is a schematic rear end view of the apparatus of U.S. Pat. No. 5,269,041 folded for insertion into a storage tank.

Referring now FIGS. 6–8, there is shown the tracked vehicle disclosed in U.S. Pat. No. 5,269,041 having foldable tracks. The tracked vehicle is generally indicated by the numeral 110 in FIGS. 6–8 and includes a platform generally indicated by the numeral 112 which is connected to two track assemblies generally indicated by the numerals 114 and 116 having inside track assembly walls 115 and outside track assembly walls 117, respectively. Platform 112 has a plurality of eyes 113 rigidly connected thereto to which cables or ropes may be attached for raising or lowering sludge removal apparatus 110. Mounted on platform 112 is a pump generally indicated by the numeral 118 having an electric, or preferably a hydraulic, motor 118*m*, discharge 120 and intake 121 connected thereto. A hose 120*a* may be connected to discharge 120 to convey sludge 121*a* from the inside of the tank being cleaned to holding tanks or the like on the outside. Sludge 121*a* enters intake 121 as shown in FIG. 7.

Pump 118 is preferably a submersible pump driven by a hydraulic motor 118*m* and is designed to pump viscous liquids such as crude oil sludge. Such pumps are well known in the art. Motor 118*m* may be operated while submerged in oil or water. Motor 118*m* is supplied with hydraulic fluid through hydraulic fluid hose 118*a* and hydraulic fluid exits through hydraulic hose 118*b*. Both hoses 118*a* and 118*b* extend to a hydraulic pump (not shown) on the outside of the tank being cleaned when the tracked vehicle 110 is placed in a tank to be cleaned. Hydraulic fluid flow through hydraulic hoses 118*a* and 118*b* can be controlled by valves (not shown) outside of the tank being cleaned and operated manually or by computers, microprocessors, or other programmable systems.

Connected to each of the track assemblies 114 and 116 are tracks 122 and 124, respectively. Tracks 122 and 124 can be made of steel coated with rubber or any other suitable material that will suit the chemical climate encountered in the tank which is being cleaned by the tracked vehicle 110 and prevent sparks. Electromagnets could be used if needed in the steel portion of the track to increase traction.

Tracks 122 and 124 are driven at their rear ends by motors 126 and 128, respectively. Motors 126 and 128 are preferably hydraulic motors which may be operated while submerged in oil or water. Motors 126*a* and 128*a* are supplied with hydraulic fluid through hydraulic fluid hoses 126*a* and 128*a,* respectively, and hydraulic fluid exits from motors 126 and 128 through hydraulic hoses 126*b* and 128*b*, respectively. All hoses 126*a,* 126*b,* 128*a*, and 128*b* extending to a hydraulic pump (not shown) on the outside of the tank being cleaned when the tracked vehicle 110 is placed in a tank to be cleaned. Hydraulic fluid flow through hydraulic fluid hoses 126*a*, 126*b*, 128*a* and 128*b* can be controlled by valves(not shown) outside of the tank being cleaned and operated manually or by computers, microprocessors, or other programmable systems.

As can be seen in FIGS. 6 and 8, track assembly 114 has two track assembly support members 114*c* and 114*d* rigidly connected to inside wall of track assembly 114 and track assembly 116 has two track assembly support members 116*c* and 116*d* connected to the inside wall of track assembly 116. L-shaped braces 115 are rigidly connected to both of the inside walls of track assembly 116 and 117 to strengthen the connection of members 114*c*, 114*d*, 116*c*, and 116*d* to track assemblies 114 and 116.

Support members 114*c*, 114*d*, 116*c*, and 116*d* can be rotated about pins 178—178 in platform 112. Stops 180—180 are rigidly connected to platform 112 to maintain track assemblies 114 and 116 in the working position shown in FIG. 6 after insertion of tracked vehicle 110 into an inlet pipe of a storage tank. Stops 180—180 stop track assemblies 114 and 116 when folded from the position shown in FIG. 6 to the position shown in FIG. 8. Two hydraulic pistons or rams 184 and 185 shown in FIG. 6 can be used to pivot track assemblies 114 and 116 about pins 178—178. Hydraulic rams 184 and 185 are used to move or pivot track assemblies 114 and 116 from the position shown in FIGS. 6 and 7 to the position shown in FIG. 8.

Hydraulic ram 184 has hydraulic fluid supply hoses 184*a* and 184*b* connected thereto, and hydraulic ram 85 has hydraulic fluid supply hoses 185*a* and 185*b* connected thereto to control the operation of the rams 184 and 185. Hydraulic hoses 184*a* and 185*b* are both connected to hydraulic hose 184*c* and hydraulic hoses 185*a* and 184*b* are both connected to hydraulic hose 185*c*. Hydraulic hose 184*c* and hydraulic hose 185*c* extend to a hydraulic pump (not shown) on the outside of the tank being cleaned when the tracked vehicle 110 is placed in a tank to be cleaned. Hydraulic fluid flow through hydraulic fluid hoses 184*c* and 185*c* can be controlled by valves (not shown) outside of the tank being cleaned and operated manually or by computers, microprocessors, or other programmable systems. Hydraulic ram 184 is pivotally connected at 184*d* to platform 112 and to the inside wall of track assembly 114 at 184*e*, and hydraulic ram 185 is pivotally connected at 185*d* to platform 112 and to the inside wall of track assembly 116 at 185*e*.

Although the preferred embodiments of the invention have been described in detail above, it should be understood that the invention is in no sense limited thereby, and its scope is to be determined by that of the following claims:

What is claimed is:

1. A waste retrieval apparatus for removing waste from an underground storage tank comprising a tank for placement in communication with said underground storage tank having waste and sludge therein, said tank having a flexible hose therein for lowering a remote controlled tracked vehicle into said underground storage tank to dislodge and remove waste from said underground storage tank and convey said waste to a storage area remote from said underground storage tank.

2. The apparatus of claim 1 wherein said tracked vehicle has foldable tracks.

3. A waste retrieval apparatus for removing waste from an underground storage tank comprising a tank for placement in communication with said underground storage tank having waste and sludge therein, said tank having a winch therein for lowering a remote controlled tracked vehicle into said underground storage tank to dislodge and remove waste from said underground storage tank and convey said waste to a storage area remote from said underground storage tank.

4. The apparatus of claim 3 wherein said tracked vehicle has foldable tracks.

* * * * *